US010458326B2

(12) United States Patent
Hittle

(10) Patent No.: US 10,458,326 B2
(45) Date of Patent: Oct. 29, 2019

(54) VEE ENGINE DUAL INBOARD CAMSHAFT SYSTEM

(71) Applicant: Caterpillar Inc., Peoria, IL (US)

(72) Inventor: Craig P. Hittle, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 244 days.

(21) Appl. No.: 15/418,398

(22) Filed: Jan. 27, 2017

(65) Prior Publication Data

US 2018/0216522 A1 Aug. 2, 2018

(51) Int. Cl.

| | |
|---|---|
| ***F02B 75/22*** | (2006.01) |
| ***F01L 1/047*** | (2006.01) |
| ***F01L 1/14*** | (2006.01) |
| ***F01L 1/18*** | (2006.01) |
| ***F02F 7/00*** | (2006.01) |
| ***F02M 63/00*** | (2006.01) |
| ***F02B 67/04*** | (2006.01) |
| ***F01L 1/02*** | (2006.01) |
| *F02B 75/18* | (2006.01) |

(52) U.S. Cl.

CPC ..... *F02B 75/22* (2013.01); *F01L 1/026* (2013.01); *F01L 1/047* (2013.01); *F01L 1/146* (2013.01); *F01L 1/18* (2013.01); *F02B 67/04* (2013.01); *F02F 7/0053* (2013.01); *F02M 63/001* (2013.01); *F01L 1/181* (2013.01); *F01L 2001/054* (2013.01); *F01L 2105/00* (2013.01); *F02B 2075/1848* (2013.01); *F02B 2075/1864* (2013.01)

(58) Field of Classification Search

CPC .. F01L 1/026; F01L 1/047; F01L 1/146; F02F 7/0053; F02B 75/22

See application file for complete search history.

(56) References Cited

U.S. PATENT DOCUMENTS

| | | | | |
|---|---|---|---|---|
| 3,452,610 A * | 7/1969 | Whitehurst | ..... | F01L 1/02 123/192.1 |
| 4,058,092 A | 11/1977 | Hikosaka et al. | | |
| 4,412,513 A | 11/1983 | Obermayer et al. | | |
| 5,479,903 A | 1/1996 | Werner et al. | | |
| 5,564,395 A * | 10/1996 | Moser | ..... | F02B 75/22 123/469 |
| 8,887,680 B2 | 11/2014 | Hayman et al. | | |

FOREIGN PATENT DOCUMENTS

| | | |
|---|---|---|
| DE | 4212110 A1 | 10/1993 |
| DE | 4405389 A1 | 8/1995 |

* cited by examiner

*Primary Examiner* — Kevin A Lathers

(74) *Attorney, Agent, or Firm* — Leydig, Voit & Mayer, LTD.

(57) ABSTRACT

An internal combustion engine includes a cylinder case that includes a first geartrain disposed on a front end of the cylinder case and a second geartrain disposed on a rear end of the cylinder case. The first geartrain drives a first camshaft, and the second geartrain drives a second camshaft, the first and second camshafts having respective rotational axes that are parallel.

18 Claims, 4 Drawing Sheets

VEE ENGINE DUAL INBOARD CAMSHAFT SYSTEM

TECHNICAL FIELD

This patent disclosure relates generally to internal combustion engines and, more particularly, to engines having two or more combustion cylinders arranged in a vee configuration.

BACKGROUND

Internal combustion engines customarily include bores containing reciprocal pistons that compress a flammable mixture of air and fuel for combustion. The delivery of air and, sometimes fuel, into the engine cylinders, and also the evacuation of exhaust gas produced as a byproduct of oxidation of the flammable mixture within the cylinder, is generally controlled by poppet valves and fuel injectors, the operation of which can be mechanical and/or electrical or hydraulic. For mechanical valve systems, poppet valves are typically used, which are activated in a reciprocal fashion by a camshaft having a follower acted upon. In some instances, a unit fuel injector may also be used to pressurize and inject a predefined quantity of fuel into the cylinder. The pressurization of the fuel is accomplished by a plunger, which can also be activated mechanically by a follower or lifter that is in contact with a rotating camshaft. A mechanical fuel delivery arrangement is especially advantageous for certain severe service applications such as for marine or locomotive engine applications.

For engines that include mechanical unit injection fuel systems, in addition to mechanical valve activation systems, a minimum of three camshaft lobes is required for each engine cylinder. As is known, a lobe is an eccentric feature of a camshaft that converts the rotational motion of the camshaft into a reciprocal axial motion of a camshaft follower, which is used to activate other engine components. Therefore, for an engine having a mechanical unit injection system, one lobe can be used to activate the fuel injection, and the remaining two lobes can be used to activate the intake and exhaust valves, respectively. For engines having multiple intake and/or exhaust valves per cylinder, or more than one fuel injection type, additional lobes may be used per engine cylinder.

As can be appreciated, multiple lobes corresponding to each engine cylinder can create packaging space constraints. The challenge with spacing is exacerbated for engines having cylinders in opposing relation such as vee-engines, which will typically include one camshaft per engine cylinder bank, which is placed on the outboard or inboard side of the engine. In these known arrangements, however, outboard camshafts result in a more complex geartrain arrangement to drive the camshafts and increase overall engine width. Likewise, previously proposed inboard camshaft arrangements can increase the driving geartrain complexity and also reduce the torsional rigidity of the driving mechanism, which over time can lead to inefficient engine operation and increased wear on the various engine components associated with the power cylinders.

One example of a previously proposed engine configuration in which two camshafts are placed in the valley of a vee-engine cylinder case can be seen in U.S. Pat. No. 5,564,395 to Moser et al. ("Moser"). Moser describes an engine having a V-shaped block in which two camshafts are placed. A first camshaft operates pushrods connected to rocker arms that activate the engine's intake and exhaust valves, and a second camshaft operates roller elements associated with pump elements, which are also placed within the valley of the V-shaped engine block. For driving the two camshafts, the engine described in Moser includes a first gear drive that establishes a direct connection between a crankshaft of the engine and the first camshaft driving the intake and exhaust valves, and a second gear drive that establishes a direct connection between the first camshaft and the second camshaft driving the pumping elements. While the dual camshaft arrangement of camshafts described in Moser is at least partially effective in alleviating space constraints, the indirect driving of the second camshaft by the first camshaft can increase the torsional elasticity of the valve and pumping unit drive system of the engine, which can also increase engine-to-engine performance variability and component wear over time.

SUMMARY

In one aspect, the disclosure describes an internal combustion engine. The internal combustion engine includes a cylinder case rotatably supporting a crankshaft having a front end and a rear end. A first geartrain is disposed on a front end of the cylinder case and is meshably connected with a first driving gear connected to the front end of the crankshaft. A second geartrain is disposed on a rear end of the cylinder case and is meshably connected with a second driving gear connected to the rear end of the crankshaft. A first camshaft is rotatably supported relative to the cylinder case and has a first rotational axis and a first driven gear connected to a front end of the first camshaft. The first driven gear is meshably connected to the first geartrain. A second camshaft is rotatably supported relative to the cylinder case. The second camshaft has a second rotational axis and a second driven gear connected to a rear end of the second camshaft. The second driven gear is meshably connected to the second geartrain. The first rotational axis and the second rotational axis are parallel.

In another aspect, the disclosure describes an internal combustion engine that includes a cylinder case rotatably supporting a crankshaft having a front end a rear end. A first geartrain is configured to be directly driven by the crankshaft. A first camshaft is rotatably supported relative to the cylinder case and has a first rotational axis. The first camshaft is driven directly by the first geartrain. A second geartrain is configured to be directly driven by the crankshaft. The second geartrain is independent from the first geartrain. A second camshaft is rotatably supported relative to the cylinder case. The second camshaft has a second rotational axis and is driven directly by the second geartrain. The first rotational axis and the second rotational axis are parallel.

DETAILED DESCRIPTION

This disclosure relates to engines having mechanically driven intake and exhaust valve activation mechanisms, and including mechanically driven unit fuel injectors. An engine in accordance with the disclosure includes a plurality of cylinders arranged in a Vee configuration having two rows or banks of cylinders, each bank of cylinders arranged in a line and disposed along a respective angled plane. The two angled planes intersect along an axis that is parallel to a centerline of a crankshaft of the engine, as is known, to form a Vee shape when viewed from a direction parallel to the angled planes. The planes may be angled at any known angle for Vee engines and, when the angle is not 180 degrees, a valley may be defined between the cylinder banks. In an engine in accordance with the disclosure, two camshafts are disposed within the valley such that the respective camshaft centerlines or rotational axes are parallel to each other and to the centerline or rotation axis of the crankshaft. The crankshaft includes driving gears at the front and back of the engine, each of which drives a respective one of the camshafts disposed in the engine valley.

In one broad aspect, therefore, the present disclosure is directed to an engine having dual inboard camshafts, which utilize the space in the "valley" of a Vee cylinder case of an internal combustion engine. The two camshafts drive the intake and exhaust valves of the engine and also mechanical unit fuel injectors. One camshaft is driven by the rear geartrain of the engine and the other camshaft is driven by the front geartrain of the engine. At times during engine operation when the injector drive function is not required, for example, when the engine fuel is cutoff for engine deceleration, or when an engine includes a different fuel system that is not mechanically driven by the camshaft altogether, an appropriate the injector camshaft and lifters may be removed. In the illustrated embodiment, the injection camshaft is located above the valve camshaft to shorten and stiffen the injection mechanism, and especially pushrods transferring motion from the injection camshaft to rocker arms associated with the unit fuel injectors.

Figure 1:
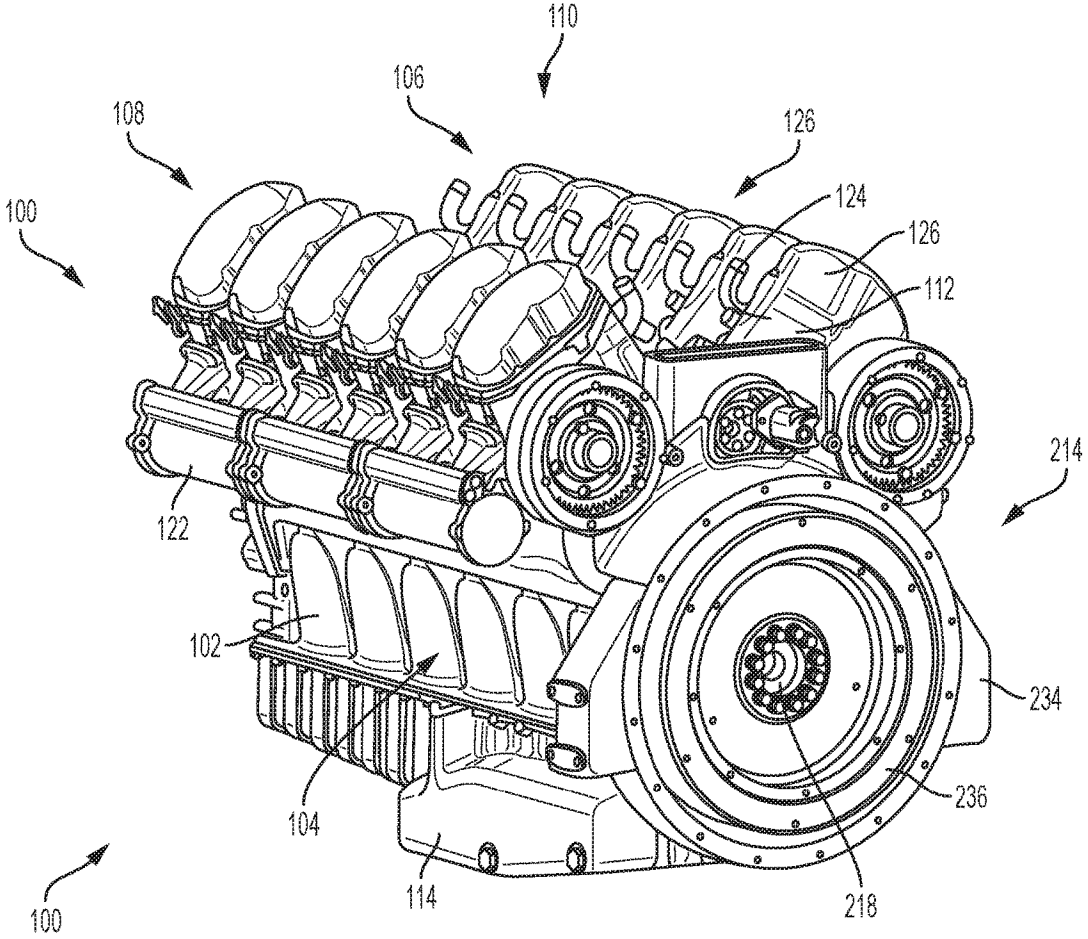
FIG. 1 is an outline view of an engine in accordance with the disclosure.
Figure 2:
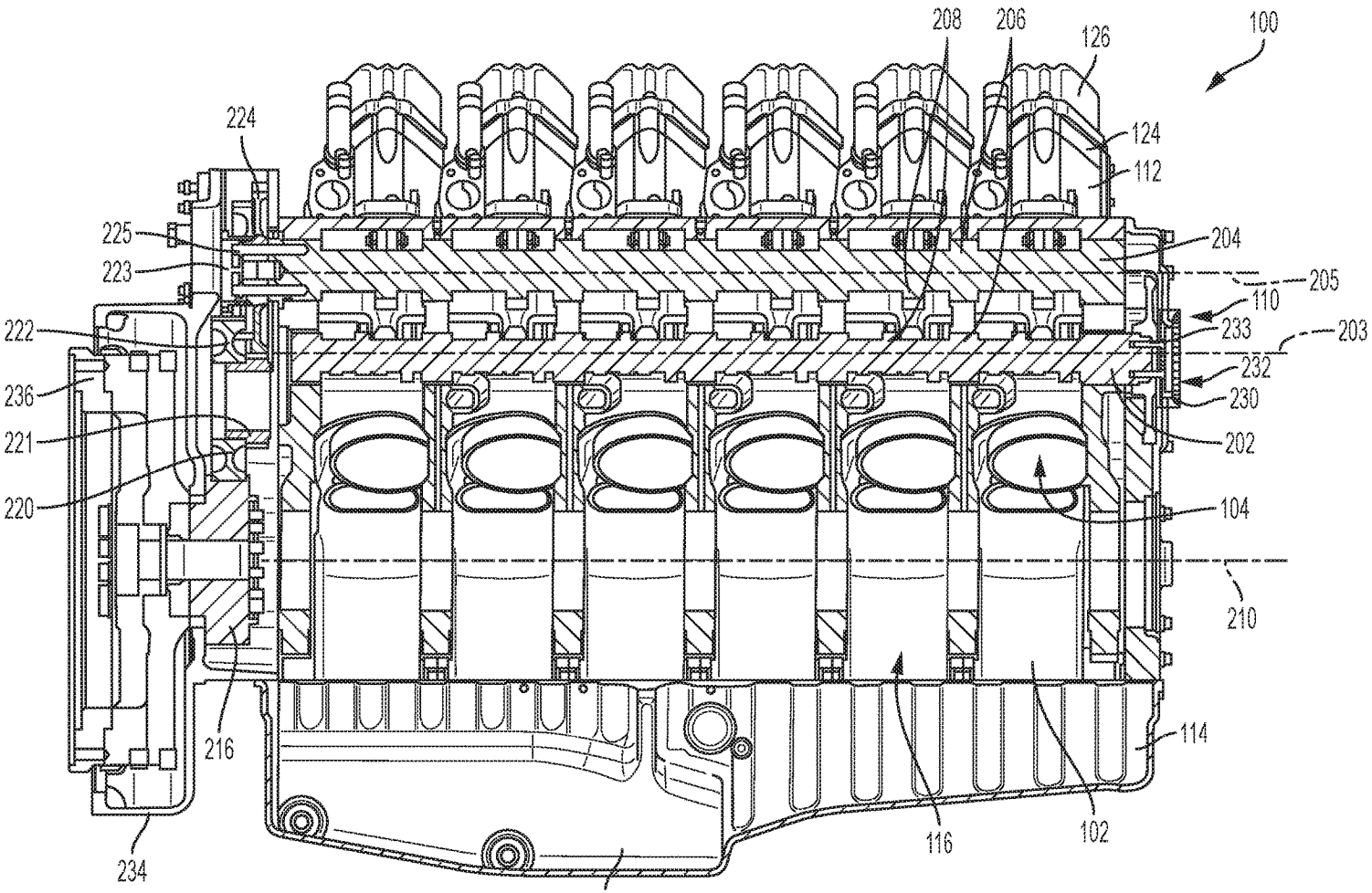
FIG. 2 is a cross section view of the engine shown in FIG. 1.
Figure 3:
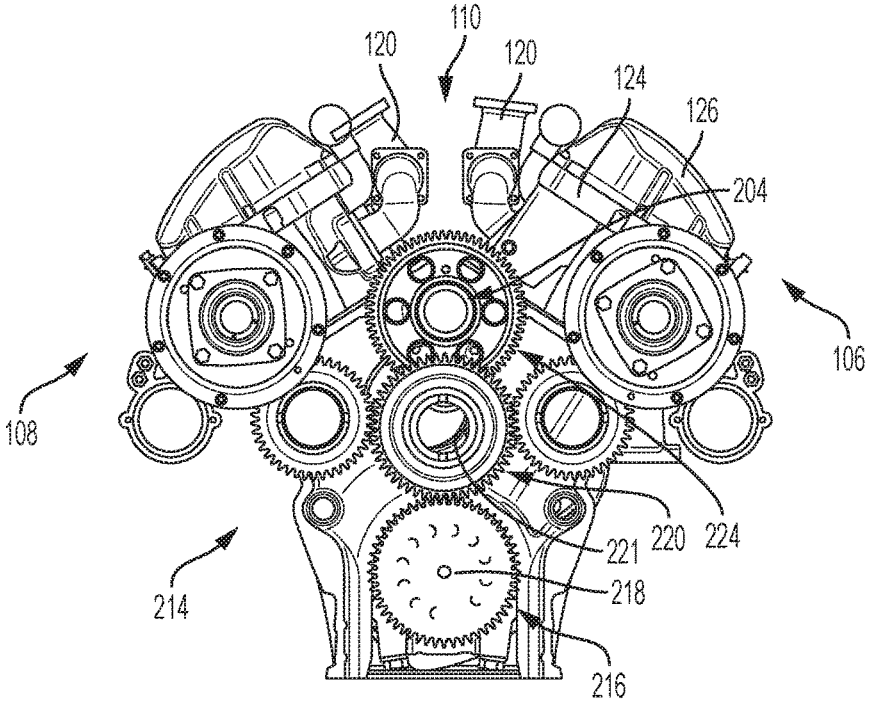
FIGS. 3 and 4 are cross section views of the engine shown in FIG. 1.
Figure 4:
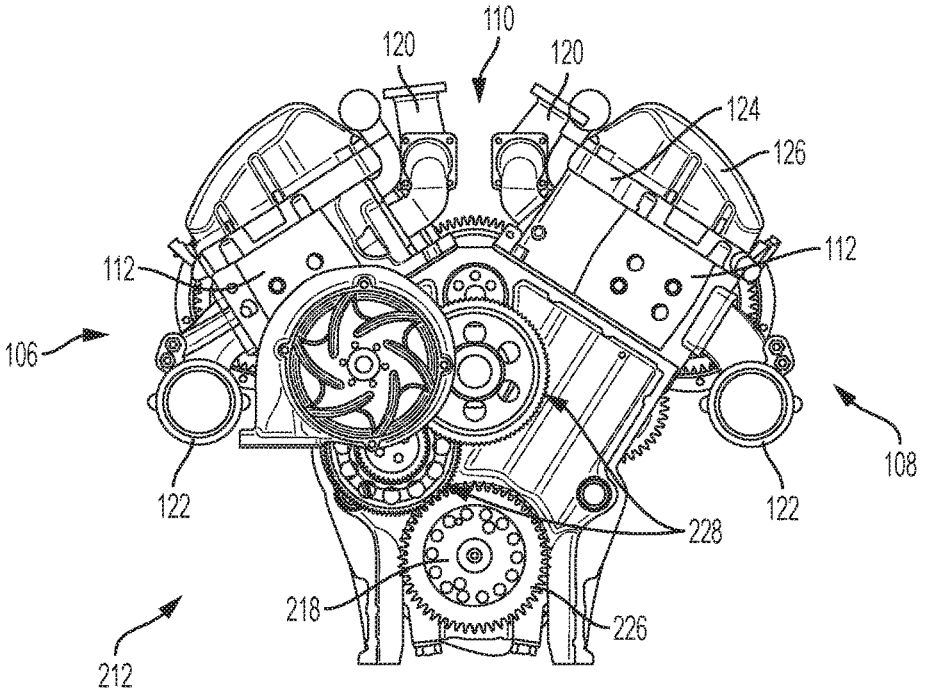

An outline view of an engine 100 in accordance with the disclosure is shown in FIG. 1, from a rear perspective, and various cross sections thereof to illustrate internal components are shown in FIG. 2, which illustrates a longitudinal section of the engine 100 through a valley area of the Vee, and FIGS. 3 and 4, which illustrate cross sections revealing the front and rear geartrains of the engine 100. In reference to these figures, the engine 100 includes a cylinder case 102 that forms a plurality of cylinder bores 104 arranged along a right bank 106 and a left bank 108. In the illustrated embodiment, the cylinder case 102 is arranged in a Vee arrangement in which the right and left banks 106 and 108 are disposed at an acute angle relative to one another and define a valley 110 between two planes disposed along the centerlines of the bores 104.

Each of the right and left banks 106 and 108 has attached thereto a cylinder head 112 shown in FIG. 4) that includes various fluid passages and supports various engine components, and further includes an oil pan 114 attached at a lower portion thereof and closing a bottom opening of an internal gallery 116 (see FIG. 2). The oil pan 114 forms a sump 118 that collects oil during operation of the engine 100. Each cylinder head 112 closes a top opening the cylinder bores 104. The cylinder bores 104 reciprocally include therein pistons (not shown) that are connected via connecting rods (not shown) to a crankshaft (also not shown), which are not illustrated in the cross section of FIG. 2 for simplicity but are known engine structures.

Attached to each cylinder head 112 are intake conduits 120, which provide air or a mixture or air and exhaust gas to the cylinders, exhaust conduits 122, risers 124, which surround engine valve activation components and fuel injection components, and valve covers 126. The engine 100 further includes two camshafts, a first camshaft 202 and a second camshaft 204, which are disposed in the valley 110. More specifically, as shown in FIG. 2, the first camshaft 202 is disposed below the second camshaft 204 along the length of the cylinder case 102 and within the valley 110. Each of the first and second camshafts 202 and 204 includes bearings 206 and eccentric lobes 208, and has a longitudinal dimension that extends along a first rotational axis 203 and a second rotational axis 205, respectively. The first and second rotational axes 203 and 205, and also a rotational axis 210 of the crankshaft (not shown), are parallel.

The first and second camshafts 202 and 204 are driven by two geartrains 212 and 214, which are shown in FIGS. 3 and 4, respectively. In reference to FIG. 3, which illustrates a cross section at the rear of the engine 100, the second geartrain 214 is shown, which is used to drive the second camshaft 204. The rear geartrain 214 includes a rear driving gear 216 (also shown in FIG. 2 in cross section) that is connected to a rear end of, and is driven by, the crankshaft 218 (not shown in FIG. 2). The rear driving gear 216 is meshed with and drives a first rear idler gear 220 that includes a toothed bushing 221 and a ring gear 222. The toothed bushing 221 includes teeth that are meshed with a second driven gear 224 connected to a rear end 223 of the second camshaft 204 by fasteners 225.

In reference to FIG. 4, which illustrates a cross section at the front of the engine 100, the first geartrain 212 is shown, which is used to drive the first camshaft 202. The front geartrain 212 includes a front driving gear 226 that is connected to a front end of, and is driven by, the crankshaft 218. The front driving gear 226 is meshed with and drives two front idler gears 228 that are meshed with one another and also with a first driven gear 230 (shown in FIG. 2) that is connected to a front end 232 of the first camshaft 202 by fasteners 233. Each of the first and second geartrains 212 and 214 is enclosed by a housing. In the illustrated embodiment, a front housing is not shown, but a rear housing 234 is shown connected to the rear of the cylinder case 102 and encloses the rear driving gear 216 and also a flywheel 236 of the engine 100.

Figure 5:
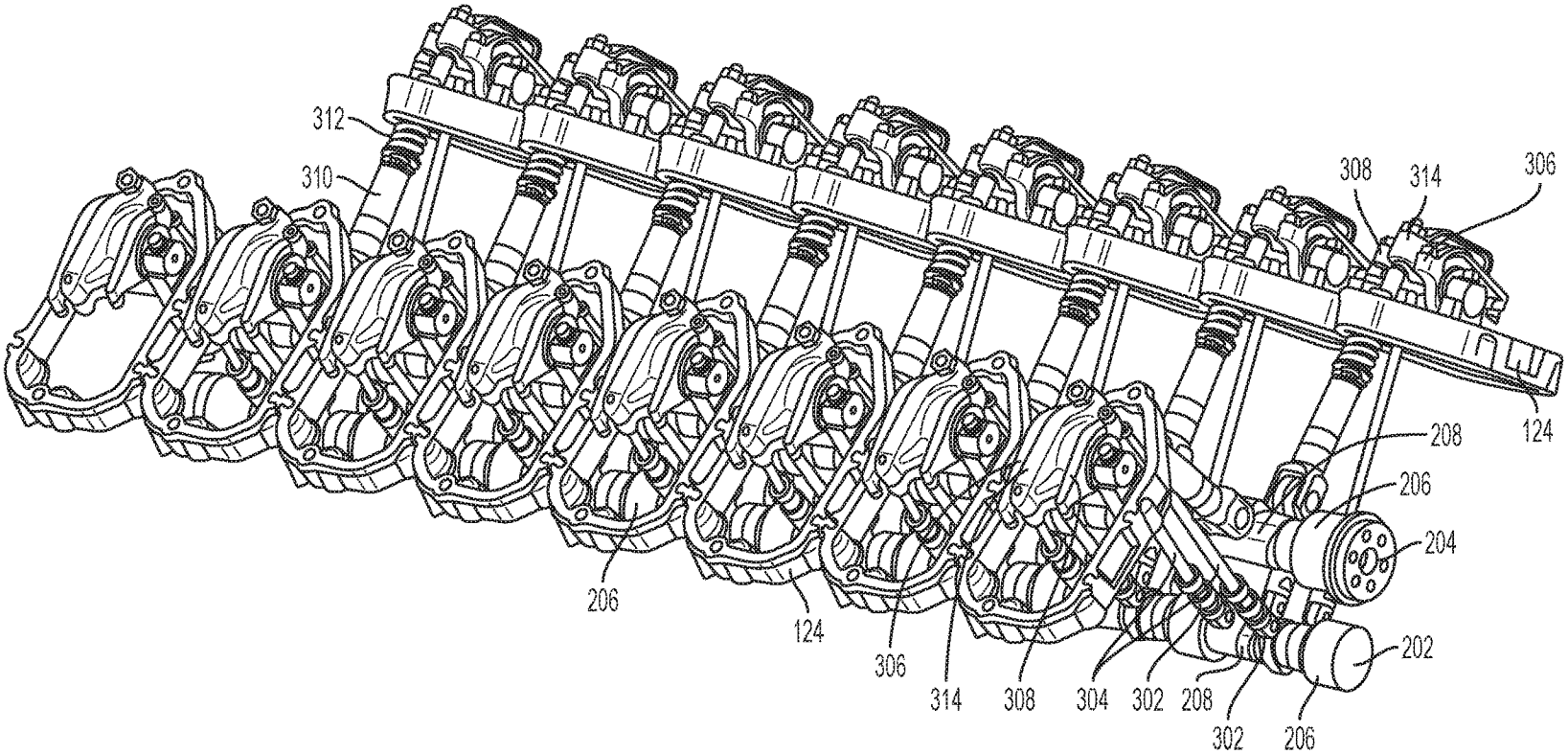
FIG. 5 is an outline view of certain engine components of the engine shown in FIG. 1, which are shown removed from the engine for illustration.

An outline view of the first and second camshafts 202 and 204, and associated driven components, shown removed from the engine 100 is shown in FIG. 5 for illustration. As can be seen from this illustration, the first camshaft 202 is disposed below the second camshaft 204 and is used to drive the intake and exhaust valves of the engine 100. In the illustrated embodiment, the lobes 208 of the first camshaft 202 have roller tappets 302 riding thereon, which follow a reciprocal motion as the first camshaft 202 rotates during engine operation. Each roller tappet 302 is connected to a pushrod 304, which in turn is connected either to an intake valve rocker arm 306 or to an exhaust valve rocker arm 308, each of which operates to open and close a corresponding intake or exhaust valve of the engine 100 in the known structural arrangement, which includes valve stems, return springs, travel limiters and the like.

Similarly, the second camshaft 204 includes lobes 208 onto which roller injection tappets 310 ride and follow a reciprocal motion as the second camshaft 204 rotates during operation. As can be appreciated, the rate of rotation may differ between the first and second camshafts 202 and 204 during engine operation depending on the selection of the various gears that make up the first and second geartrains 212 and 214. The roller injection tappets 310 include springs 312 providing a return and biasing force to maintain contact of the roller injection tappets 310 with the lobes 208 of the second camshaft 204. The roller injection tappets 310 are connected to injector rocker arms 314 that operate fuel injectors, for example, mechanically actuated, hydraulically amplified fuel injectors such as the fuel injectors described in U.S. Pat. No. 6,003,497, the disclosure of which is incorporated herein by reference, or similar injectors operating to provide a liquid fuel such as diesel or a gaseous fuel such as liquefied natural gas (LNG) into the engine cylinders. As can be seen from FIG. 5, the driving arrangement for the intake and exhaust valves, and also the fuel injectors, may be replicated once for each engine cylinder. In the illustrated embodiment of FIG. 1, twelve cylinders are shown arranged along two six-cylinder banks, but other cylinder numbers can be used.

INDUSTRIAL APPLICABILITY

The present disclosure is applicable to any type of engine having dual camshafts to drive cylinder valve activation components and mechanical unit fuel injection arrangements. It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. An internal combustion engine, comprising:

a cylinder case rotatably supporting a crankshaft having a front end and a rear end;

a first geartrain disposed on a front end of the cylinder case, the first geartrain being meshably connected with a first driving gear connected to the front end of the crankshaft;

a second geartrain disposed on a rear end of the cylinder case, the second geartrain being meshably connected with a second driving gear connected to the rear end of the crankshaft;

a first camshaft rotatably supported relative to the cylinder case, the first camshaft having a first rotational axis and having a first driven gear connected to a front end of the first camshaft, the first driven gear being meshably connected to the first geartrain, wherein the first camshaft operates intake and exhaust valves associated with cylinders formed in the cylinder case;

a second camshaft rotatably supported relative to the cylinder case, the second camshaft having a second rotational axis and having a second driven gear connected to a rear end of the second camshaft, the second driven gear being meshably connected to the second geartrain, wherein the second camshaft operates unit fuel injectors associated with the cylinders formed in the cylinder case;

wherein the first rotational axis and the second rotational axis are parallel, and wherein the intake and exhaust valves operate independently from the unit fuel injectors.

2. The internal combustion engine of claim 1, further comprising a rotational axis of the crankshaft, wherein the rotational axis of the crankshaft is parallel to the first rotational axis and the second rotational axis.

3. The internal combustion engine of claim 1, wherein the cylinder case has a Vee configuration that includes a first plurality of cylinders arranged along a first bank and a second plurality of cylinders arranged along a second bank, wherein a valley is defined between the first bank and the second bank, and wherein the first and second camshafts are disposed in the valley.

4. The internal combustion engine of claim 3, wherein each cylinder in the first plurality of cylinders and the second plurality of cylinders includes an intake valve operated by an intake rocker and a pushrod, and an exhaust valve operated by an exhaust rocker and an additional pushrod, wherein each of the pushrod and the additional pushrod includes a roller tappet, and wherein the roller tappets ride on lobes formed on the first camshaft.

5. The internal combustion engine of claim 3, wherein each cylinder in the first plurality of cylinders and the second plurality of cylinders includes a mechanical unit fuel injector operated by an injector rocker and an injector roller tappet, and wherein the injector roller tappet rides on a lobe formed on the second camshaft.

6. The internal combustion engine of claim 5, further comprising a spring disposed to provide a biasing force that pushes the injector roller tappet into contact with the lobe formed on the second camshaft.

7. The internal combustion engine of claim 3, wherein the first camshaft is disposed below the second camshaft in the valley.

8. The internal combustion engine of claim 1, wherein the first geartrain includes at least one idler gear.

9. The internal combustion engine of claim 1, wherein the second geartrain includes at least one idler gear.

10. The internal combustion engine of claim 1, wherein the first geartrain is configured to rotate the first camshaft at a different speed than the second geartrain is configured to rotate the second camshaft for any given rotation speed of the crankshaft.

11. The internal combustion engine of claim 1, wherein the first geartrain includes at least one idler gear, and wherein the second geartrain includes at least one idler gear.

12. An internal combustion engine, comprising:

a cylinder case rotatably supporting a crankshaft having a front end and a rear end;

a first geartrain configured to be directly driven by the front end of the crankshaft;

a first camshaft rotatably supported relative to the cylinder case, the first camshaft having a first rotational axis and being driven directly by the first geartrain;

a second geartrain configured to be directly driven by the rear end of the crankshaft, the second geartrain being independent from the first geartrain;

a second camshaft rotatably supported relative to the cylinder case, the second camshaft having a second rotational axis and being driven directly by the second geartrain;

wherein the first rotational axis and the second rotational axis are parallel;

wherein the first and second camshafts are arranged to rotate at different speeds for any given rotation speed of the crankshaft; and wherein the cylinder case has a Vee configuration that includes a first plurality of cylinders arranged along a first bank and a second plurality of cylinders arranged along a second bank, wherein a valley is defined between the first bank and the second bank, and wherein the first and second camshafts are disposed in the valley.

13. The internal combustion engine of claim 12, wherein the second camshaft has a second driven gear connected to a rear end of the second camshaft, the second driven gear being meshably connected to the second geartrain.

14. The internal combustion engine of claim 12, wherein the first camshaft has a first driven gear connected to a front end of the first camshaft, the first driven gear being meshably connected to the first geartrain.

15. The internal combustion engine of claim 12, wherein the first geartrain is disposed on a front end of the cylinder case, the first geartrain being meshably connected with a first driving gear connected to the front end of the crankshaft, and wherein the second geartrain is disposed on a rear end of the cylinder case, the second geartrain being meshably connected with a second driving gear connected to the rear end of the crankshaft.

16. The internal combustion engine of claim 12, further comprising a rotational axis of the crankshaft, wherein the rotational axis of the crankshaft is parallel to the first rotational axis and the second rotational axis.

17. The internal combustion engine of claim 12, wherein each cylinder in the first plurality of cylinders and the second plurality of cylinders includes:

an intake valve operated by an intake rocker and a pushrod;

an exhaust valve operated by an exhaust rocker and an additional pushrod, wherein each of the pushrod and the additional pushrod includes a roller tappet, and wherein the roller tappets ride on lobes formed on the first camshaft;

a mechanical unit fuel injector operated by an injector rocker and an injector roller tappet, wherein the injector roller tappet rides on a lobe formed on the second camshaft.

18. The internal combustion engine of claim 12, wherein the first camshaft is disposed below the second camshaft in the valley.

* * * * *